United States Patent [19]

Scott

[11] Patent Number: 4,668,552

[45] Date of Patent: May 26, 1987

[54] WRAP YARNS HAVING LOW-MELT BINDER STRANDS AND PILE FABRICS FORMED THEREFROM AND ATTENDANT PROCESSES

[75] Inventor: Eddie W. Scott, Mebane, N.C.

[73] Assignee: Collins & Aikman Corporation, New York, N.Y.

[21] Appl. No.: 891,198

[22] Filed: Jul. 28, 1986

[51] Int. Cl.[4] ..... B32B 3/02; B32B 33/00

[52] U.S. Cl. ..... 428/92; 57/210; 57/227; 57/252; 156/72; 428/93; 428/94; 428/96; 428/97; 428/357; 428/377

[58] Field of Search ..... 428/92, 93, 94, 96, 428/97, 357, 377; 57/210, 227, 252; 156/72

[56] References Cited

U.S. PATENT DOCUMENTS

| | | | |
|---|---|---|---|
| 4,018,042 | 4/1977 | Maag et al. | 57/144 |
| 4,028,874 | 6/1977 | Maag et al. | 57/144 |
| 4,267,864 | 5/1981 | Kocay | 139/420 R |
| 4,356,690 | 11/1982 | Minorikawa et al. | 57/210 |
| 4,484,433 | 11/1984 | Stahlecker et al. | 57/15 |

*Primary Examiner*—Marion C. McCamish
*Attorney, Agent, or Firm*—Bell, Seltzer, Park & Gibson

[57] ABSTRACT

A pile fabric is formed from interengaging ground yarns and cut pile tufts formed of wrap yarns extending upwardly from the ground yarns to form the face of the fabric. Each of the wrap yarns comprises a body strand of untwisted staple fibers and a binder strand helically wrapped around the body strand. The binder strands are preferably crimped textured strands and formed of a thermoplastic polymer having heat shrinkable and fusible properties and a relatively low melting point of less than about 300° F. The staple fibers and ground yarns are formed of a material unaffected at the relatively low melting point of the binder strand. When a moderated amount of heat is applied to a cut pile fabric formed from such wrap yarns, the binder yarns shrink and are retractably positioned inwardly away from the face of the pile fabric and are hidden among the pile tufts and not visible. When a greater amount of heat is applied to the pile fabric, the binder strands melt and thereafter resolidify into randomly arranged discrete portions of binder strand material which fusibly interconnect the staple fibers with one another and with the ground yarns. The shrinking, melting and resulting improved properties of the pile fabric can be further enhanced by appropriate finishing steps.

39 Claims, 9 Drawing Figures

10
15
16
17
20
WEAVE PLUSH FABRIC
30
CUTTING DURING WEAVING
40
FINISHING
43
HEATING
44
BRUSHING
45
SHEARING
50
BACKCOATING
11
12
13

WRAP YARNS HAVING LOW-MELT BINDER STRANDS AND PILE FABRICS FORMED THEREFROM AND ATTENDANT PROCESSES

This application is related to concurrently filed copending application Ser. No. 06/890,915 filed July 28, 1986 for "Wrap Yarns Having Crimped Textured Binder Strands and Pile Fabrics Formed Therefrom and Attendant Processes". The present invention relates to the structure and manufacture of cut pile fabrics and to particular yarns used to make such fabrics.

BACKGROUND OF THE INVENTION

Cut pile fabrics have a variety of applications for which they are particularly suitable. As used herein, the term "cut pile fabric" refers to a fabric which comprises a ground fabric into which are positioned upwardly facing cut pile tufts. A number of methods for producing such fabrics are well known and include cutting loop pile tufts to thereby produce cut pile or by plush weaving techniques wherein upper and lower ground fabrics are woven and are interconnected by pile yarns extending therebetween. By cutting the pile yarns between the two fabrics, a resulting cut pile face can be produced on each fabric.

One recent relatively widespread use of cut pile fabrics has been in the manufacture of automotive upholsteries. In such applications, these fabrics are especially useful for seating surfaces as they are more comfortable to the touch in both hot and cold weather and have a rich appearance, feel and texture. Accordingly, improved production of such fabrics is currently commercially significant.

One recently developed method of forming cut pile fabrics suitable for the facing portions of automotive upholstery includes the use of "wrap yarns". As the name implies, a wrap yarn is formed by wrapping a binder strand, usually made up of one or more continuous synthetic filaments, around an untwisted body strand produced from staple fibers. Because the binder strand imparts structural integrity to the entire wrap yarn, no twist is necessary in the body strand. When used to form the upstanding pile portions of a cut pile fabric, wrap yarns provide good surface coverage and appearance. The untwisted characteristics of the body strands allows the cut faces of the staple fibers to blossom or spread apart to a greater degree and enhance their surface coverage.

Nevertheless, although suitable for certain upholstery applications, cut pile fabrics made from such wrap yarns also suffer from particular disadvantages characteristic of their nature and construction. One serious problem arises from the differences between the fiber characteristics of the body strand and those of the binder strand. As stated earlier, the body strand is formed from staple fibers of particular individual or blended character and the binder strand is typically formed of continuous filaments of a different fiber having a different character. Accordingly, obtaining a consistent, identical color for the binder and body strands is almost impossible even where the wrap yarn or fabric made from it is piece dyed. When such yarns are dark colored yarns, the visible difference in color between the binder strands and the body strands is increasingly troublesome, even though the binder strand typically makes up less than 10 percent of the total weight of the wrap yarn. The result can be described in textile jargon as a "salt and pepper" effect in which the differently colored or non-colored binder yarns appear on the face of the cut pile fabric. To date, however, no satisfactory solutions have existed for obtaining the desired coverage and texture of cut pile fabrics formed from wrap yarns while avoiding the accompanying aesthetic problems.

One attempt at eliminating the aesthetic problems associated with cut pile fabrics formed from such wrap yarns has been to include a flat monofilament binder strand as part of the wrap yarn. Generally speaking, such flat monofilament fibers are most often colorless and transparent and consequently are not visible on the face of a cut pile fabric the way less transparent textured multifilament binder strands are. Typical commercial multifilament strands often appear white. Nevertheless, because a single flat monofilament binder strand will of necessity usually be larger than would be the individual filaments of a multifilament binder strand, the relatively large and consequently stiffer binder yarn gives the resulting pile fabric a poor hand which is bristly or prickly to the touch.

A second problem characteristic of such fabrics is that the low twist characteristics of the body strand which are so favorable in the final product can cause handling problems during the process or finishing steps in forming the fabric. In particular, because the staple fibers of the body strand essentially have no twist, they are characteristically held together by binder strands which, as stated above, are typically present less than 10 percent by weight. As a result, the body strand tufts of the wrap yarns tend to become detached from the ground yarns of the fabric when the wrap yarns are cut to form the piles of a fabric. The result is a troublesome loss of the cut pile tufts. If enough of the pile tufts become dislodged from the fabric, the resulting deterioration of the integrity and appearance of the fabric can relegate the fabric to second quality.

Accordingly, there exists the need for enhancing the structural integrity of such fabrics during their manufacture as well as improving the appearance of the resulting fabrics.

It is thus an object of the present invention to provide a cut pile fabric formed from wrap yarns which includes the desired surface characteristic wrap yarns provide, but which overcomes the problems attendant to stiff and/or visible binder strands by use of shrinkable low-melt binder strands.

It is a further object of this invention to provide a cut pile fabric in which the low-melt binder strands are shrunken or retracted inwardly from the face of the cut pile fabric so as to be hidden among the cut pile tufts and not visible on the face of the fabric.

It is a further object of this invention to provide a wrap yarn formed from a body strand and a low-melt binder strand of such characteristics that when included in a cut pile fabric, the binder strands will retract away from the face of the cut pile fabric and be hidden among the pile tufts and not visible on the face of the fabric.

It is another object of the invention to provide a cut pile fabric from a wrap yarn which is formed of a shrinkable, low-melt fusible material so that the fabric can be treated to fuse the binder strands and thereby connect binder strands, body strands and ground yarns to one another and enhance the integrity of the fabric.

It is yet another object of the invention to provide a method of making a cut pile fabric having enhanced surface characteristics and a consistent aesthetic appearance by forming a pile fabric from wrap yarns in which the binder strand is formed of a shrinkable low temperature fusible thermoplastic polymer material and helically wrapped around the body strand, so that when the pile tufts formed from such yarns are cut to form the cut pile fabric face and the fabric heat treated in a finishing process, the shrinking and fusion of the binder strand draws it inwardly from the face of the fabric, keeps it hidden among the pile tufts and causes it to interconnect the staple fibers of the body strand and interengaging ground yarns of the resulting fabric.

It is a further object of the present invention to use the regular aspects of fabric finishing treatment to enhance the retraction and effect fusion of such binder strands inwardly away from the face of the cut pile fabric.

SUMMARY OF THE INVENTION

The present invention comprises a cut pile fabric formed of interengaging ground yarns and cut pile tufts formed of wrap yarns extending from the ground yarns to form the face of the fabric. Each of the wrap yarns comprises a body strand of untwisted staple fibers and a binder strand helically wrapped around the body strand. The binder strand is formed of a thermoplastic polymer having heat-shrinkable and fusible properties and a relatively low melting point of less than about 300° F., at which temperature the staple fibers and ground yarns remain unaffected. In some embodiments, the binder strands are shrunken and retractably positioned inwardly away from the face of the pile fabric so as to be hidden among the pile tufts and not visible. In other particular embodiments, the fabric is heated to the melting point of the binder strand material, which causes the binder strand to be retracted and repositioned inwardly away from the cut face of the pile fabric and to be melted and thereafter resolidified into randomly arranged discrete portions of binder strand material which have no resemblance to a strand. Some of these discrete portions of binder strand material fusibly interconnect some of the staple fibers of the body strands with one another and with the ground yarns.

DESCRIPTION OF THE DRAWINGS

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments, and wherein.

DETAILED DESCRIPTION

Figures 1, 2, 3, 4:
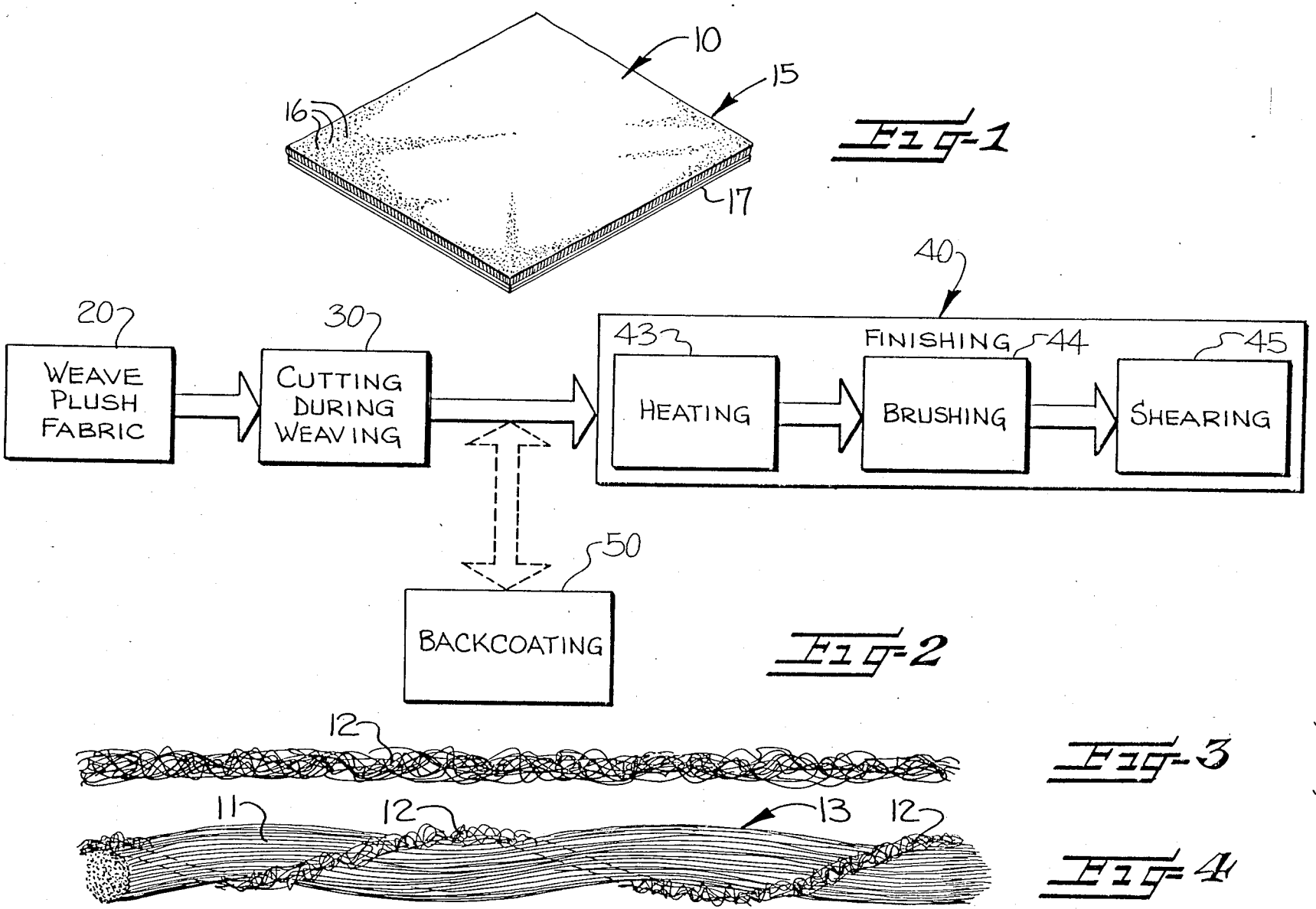
FIG. 1 is a perspective view of a portion of the finished cut pile fabric.
FIG. 2 is a schematic diagram of the preferred method of the invention and showing the individual steps therein.
FIG. 3 is an enlarged schematic view of a typical textured binder strand.
FIG. 4 is a schematic view of a wrap yarn formed from a staple fiber body strand and a helically positioned textured binder strand therearound.

The present invention comprises a wrap yarn adapted to be used for forming pile in cut pile fabrics and particular cut pile fabrics formed therefrom. Such a cut pile fabric is illustrated in perspective view in FIG. 1 and is broadly designated at 10. According to the present invention, the cut pile tufts which form the face of the fabric are formed of wrap yarns extending from interengaging ground yarns to form the face of the fabric. As illustrated in FIGS. 3 and 4, each of the wrap yarns comprises a body strand 11 formed of untwisted staple fibers and a textured binder strand 12 helically wrapped around the body strand to form a wrap yarn broadly designated at 13. As illustrated in FIG. 3, in particular embodiments of the invention, the low-melt binder strand 12 is a crimped textured strand, has extensible and retractable properties, and is formed of a thermoplastic polymer having heat shrinkable and fusible properties and a predetermined relatively low melting point temperature; less than about 300° F. in preferred embodiments. As used herein, the term "low-melt" describes the polymeric materials from which such binder strands can be formed. In these embodiments, the staple fibers and ground yarns of the pile fabric are formed of materials which remain unaffected at the relatively low melting point of the binder strand.

In a preferred embodiment of the invention, the binder strand 12 is wrapped around the body strand 11 in a tensioned condition so as to be axially extended and reduced in bulk compared to the condition the binder strand 12 would assume when relaxed. As further seen in FIGS. 3 and 4, in preferred embodiments the wrap yarn comprises a crimped textured multifilament binder strand which is preferably formed by false twist crimp texturing to produce its extensible and retractable properties. Other methods of producing crimped textured binder strands are also acceptable, such as stuffer box processes, edge-crimping and knit-deknit techniques.

Appropriate materials for forming the low melt binder strand include commercially available adhesive copolymers of which copolyamides and copolyesters are preferred and which melt and fuse at temperatures of less than about 300° F. A binder strand formed from such materials shrinks when subjected to temperatures less than the melting point of the material and melts into randomly arranged discrete portions of binder strand material when subjected to temperatures at or above the relatively low melting point.

Various materials for forming the body strand are preferably synthetic fibers such as polyamide, polyester, polypropylene and acrylic fibers. If desired, the staple fibers may be natural fibers such as wool or cotton, for example. In typical applications, the synthetic staple fibers are about two inches in length.

Additionally, in preferred embodiments of the invention, the wrap yarn will be characterized by binder strands of a size of approximately 40 denier multifilament with 13 filaments each of about 3 denier, and staple fiber body strands of about a 10's count according to the cotton system. Expressed somewhat differently, the binder strands generally comprise between about 3 to 10 percent by weight of the wrap yarn and in preferred embodiments comprise between about 5 to 8 percent by weight of the wrap yarn. The invention is not limited, however, to the production of plush pile fabrics, but is useful in many other types of pile fabrics. It will be understood that in other pile fabrics, the yarn sizes of both binder and body strand, and their proportional relationship to one another, can vary widely.

As diagrammed schematically according to FIG. 2, preferred embodiments of the cut pile fabrics of the present invention can be made by forming a cut pile fabric by plush fabric weaving techniques wherein interengaging ground yarns are woven into upper and lower fabrics with interengaging pile yarns extending therebetween. The cut pile fabric utilizes the wrap yarns of the present invention for the piles thereof and these piles are cut during the weaving process to form the cut pile fabric. As shown in FIG. 2, the resulting fabric also undergoes backcoating and finishing treatments.

In preferred embodiments of the invention, the finishing of the fabric comprises heating the fabric to a temperature of about 230° F. or higher, thereafter brushing the heat softened fabric to orient the fibers more uniformly after which a shearing step levels any fibers of excess height which would otherwise give an uneven appearance to the fabric. The fabric is typically backcoated prior to finishing to provide structural integrity during further handling and use.

In the schematic diagram of FIG. 2, the weaving step is designated 20, the loom cutting step 30, the entire finishing step broadly as 40, the backcoating step as 50. Within the broad finishing step 40 are the individual steps of heating 43, then brushing 44, and shearing 45.

As indicated, production of plush pile fabric also preferably includes backcoating. Given the nature of the wrap yarns, the pile fabric formed and the handling required prior to final use of the fabric, the backcoating adds necessary structural integrity to the plush fabric. Typical backcoating materials found to be appropriate include low melt thermoplastic adhesive polymers. It will be understood that in the production of other types of cut pile fabrics according to the present invention, other finishing techniques may be preferred which may or may not include certain of the specific steps found most suitable for plush fabrics.

Various aspects of the method of making the pile fabrics and the specific structures which result are best illustrated in FIGS. 5 through 9.

Figure 5:
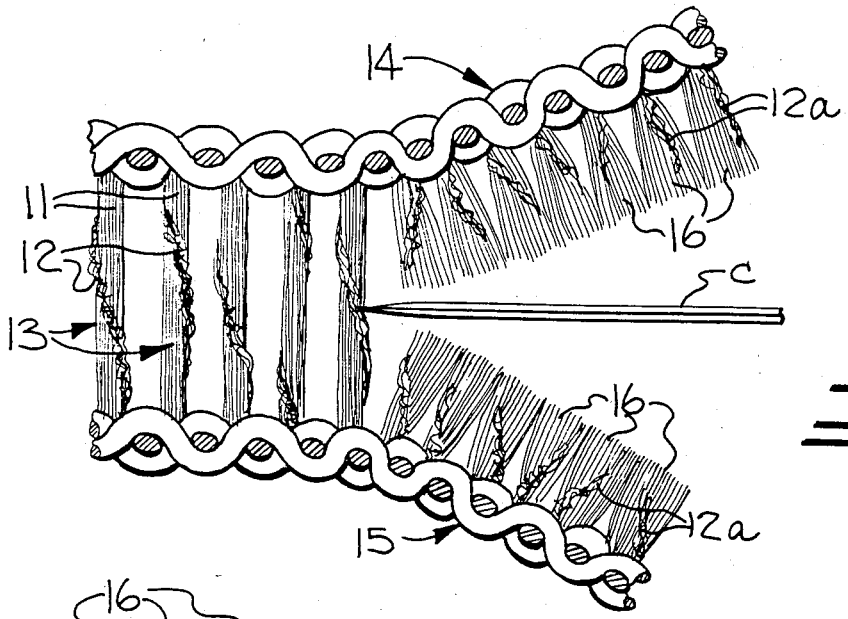
FIG. 5 is a schematic cross-sectional view of upper and lower woven pile fabrics formed by plush weaving and wherein the wrap yarns of the present invention are utilized and showing the mechanical retraction of the binder strands upon cutting the pile yarns extending between the upper and lower fabrics.
Figure 6:
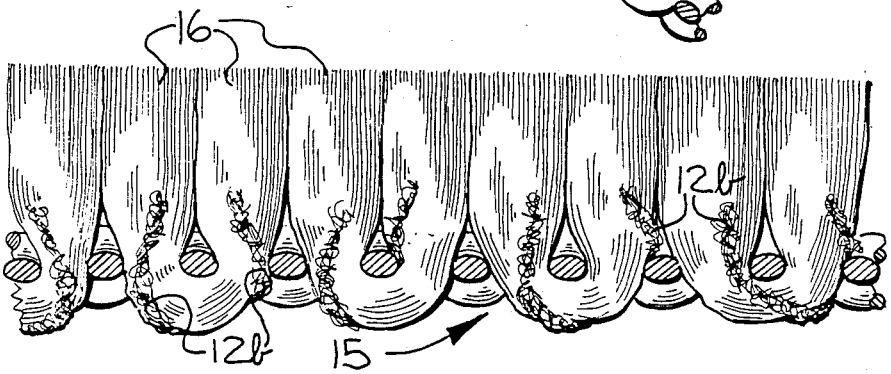
FIG. 6 is a schematic cross-sectional view of a preferred pile fabric according to the present invention and showing the retracted binder strands and the cut pile tufts formed from the body strands.
Figure 7:
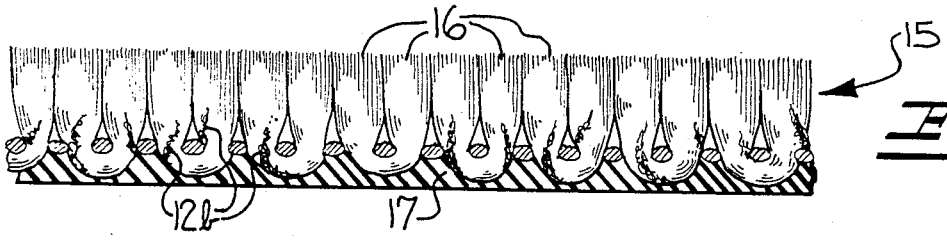
FIG. 7 is a schematic cross-sectional view similar to FIG. 6 and showing a backcoating applied to the cut pile fabric.

As shown in FIGS. 5, 6 and 7, one preferred method of making such pile fabrics comprises forming upper and lower woven ground fabrics, 14 and 15 respectively, by plush fabric weaving techniques. The pile yarns extending between the upper and lower fabrics are wrap yarns of this invention. As described previously herein, each of the wrap yarns which make up the piles comprises a body strand of untwisted staple fibers and a low-melt crimped textured binder strand having extensible and retractable properties and formed from a fusible thermoplastic polymer having a relatively low melting point of less than about 300° F. As illustrated in FIG. 5, the binder strand 12 of the wrap yarn 13 is helically wrapped around the body strand 11 in a tensioned condition so as to be axially extended and reduced in bulk compared to the condition the crimped textured binder strand 12 would assume when relaxed.

The upper and lower ground fabrics 14 and 15 are separated from one another by cutting the interconnecting pile yarns therebetween using a cutter C so as to form pile tufts 16 on the face of each of the separated pile fabrics 14 and 15. As illustrated in FIGS. 5, 6 and 7, cutting the pile yarns 13 relaxes the tensioned condition of the crimp textured binder strands 12 and causes the binder strands to mechanically retract to a position inwardly from the cut face of the pile fabric. This initial inwardly retracted position is best illustrated in FIG. 5 in which the relaxed binder strands are designated at 12*a*.

When the upper and lower fabrics 14 and 15, are so separated, each resulting fabric comprises interengaging ground yarns and cut pile tufts extending therefrom to form the face of the fabric. The binder yarns are retractably positioned inwardly away from the face of the pile fabric and are hidden among the pile tufts and are not visible.

Because the binder strand materials used in the wrap yarns according to the present invention are shrinkable at relatively low temperatures, the resulting fabrics can be further treated with heat at relatively low temperatures to enhance the characteristics of the fabric while leaving the staple fibers of the body strand and the ground yarns unaffected.

Accordingly, the method of the present invention further comprises additional treatments for improving a cut pile fabric which includes the wrap yarns of the present invention, regardless of the particular manner in which the cut pile fabric is formed. In such embodiments, the method further comprises applying heat to the pile fabric so as to cause the binder strands to shrink and retract inwardly in a direction further away from the face of the pile fabric and to be hidden deeper among the pile tufts. With the binder strands so retracted away from the face of the fabric, the upper portions of the body strands can expand and enhance the uniformity of the face of the pile fabric. The resulting effect of heat on the fabric is designated in FIGS. 6 and 7 in which the heat-shrunk binder strands are designated 12*b*. FIG. 7 illustrates a backcoating 17 added to the fabric in a typical manner.

Because the binder strands are also fusible at predetermined relatively low melting point temperatures, preferably no more than about 300° F., the method of the invention further comprises applying heat to the pile fabric so as to heat the fabric to the low melting point temperature of the binder strand material and to melt the binder strand into randomly arranged discrete portions of binder strand material. These discrete portions are schematically designated at 18 in FIGS. 8 and 9 and are positioned inwardly away from the cut face of the pile fabric and no longer have any resemblance to a strand. When the randomly arranged discrete portions of binder strand material are thereafter permitted to resolidify, the discrete portions will fusibly interconnect staple fibers forming some of the lower portions of the body strands with one another and will likewise permit some of the randomly arranged resolidified discrete portions of binder strand material to connect some of the staple fibers with the ground yarns.

Figure 8:
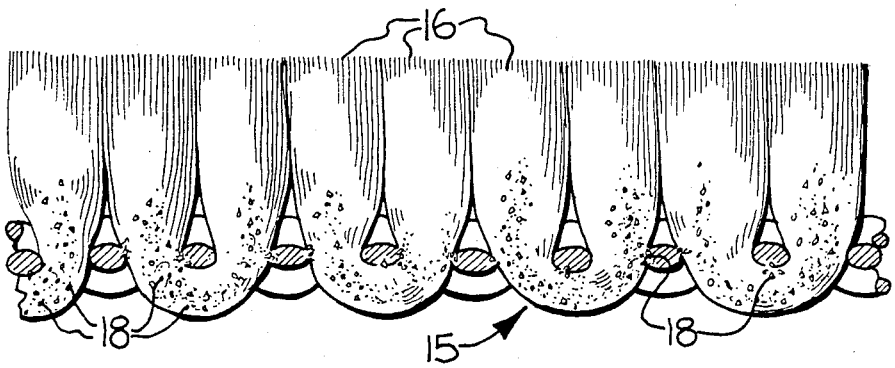
FIG. 8 is an enlarged schematic cross-sectional view of the preferred pile fabric of the present invention and showing the binder strands melted into randomly arranged discrete portions of binder strand material which interconnect the staple fibers of the body strand with one another and with the ground yarns.
Figure 9:
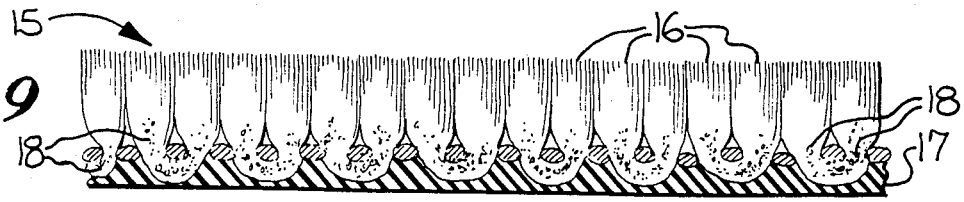
FIG. 9 is another schematic view similar to FIG. 8 but on a smaller scale and showing a backcoating applied to the cut pile fabric.

The fabric resulting from such treatment is best illustrated in FIGS. 8 and 9 in which the melted binder strand material is shown as stippling 18 present in lower portions of the body strands, of which upper portions form the pile tufts 16 of the face of the fabric. FIG. 9, shows the fabric with a backcoating 17.

The wrap yarn of the present invention and the resulting fabrics formed therefrom are especially suitable where plush fabrics are required having a dense pile face and pile heights of between about 3/16" and ¼". These fabrics have outstanding aesthetic qualities regardless of color, a high quality hand and an improved structural integrity.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A pile fabric comprising interengaging ground yarns and cut pile tufts formed of wrap yarns extending therefrom and forming the face of the fabric, each of said wrap yarns comprising a body strand of untwisted staple fibers and a binder strand helically wrapped around said body strand, and wherein said binder strand is formed of a thermoplastic polymer having heat-shrinkable and fusible properties and a relatively low melting point of less than about 300° F., and at which relatively low melting point temperature said staple fibers and ground yarns remain unaffected, and wherein said binder strand shrinks and retracts when subjected to temperatures less than said melting point of the binder strand, and wherein said binder strands are shrunken and retractably positioned inwardly away from the face of the pile fabric so as to be hidden among the pile tufts and not to be visible.

2. A pile fabric comprising interengaging ground yarns and cut pile tufts formed from wrap yarns and extending from the ground yarns and forming the face of the fabric, each of said wrap yarns comprising a body strand of untwisted staple fibers and a binder strand helically wrapped around said body strand, said binder strand being formed of a heat shrinkable, fusible thermoplastic material having a relatively low melting point of less than about 300° F., and wherein said binder strand shrinks and retracts when subjected to temperatures less than said melting point of the binder strand and melts into randomly arranged discrete portions at said low melting point temperatures, and said ground yarns and said body strand being formed of fibers unaffected by temperatures of up to about 300° F. so that said binder strand material may readily be melted at temperatures which do not affect the integrity of said ground yarns and staple fibers, said binder strand having been heated to said melting point temperature so as to cause the binder strand to be retracted inwardly away from the cut face of the pile fabric and to be melted and resolidified into randomly arranged discrete portions of binder strand material having no resemblance to a strand, and some of said discrete portions of binder strand material fusibly interconnecting some of said staple fibers of said body strand with one another and with said ground yarns.

3. A pile fabric according to claim 2 wherein each of said binder strands are textured.

4. A pile fabric according to claim 2 wherein each of said binder strands is formed of crimped textured filaments and has extensible and retractable properties.

5. A pile fabric according to claim 4 wherein each of said binder strands is false twist crimped and textured.

6. A pile fabric according to claim 2 wherein said binder strands comprise between about 3 to 10 percent by weight of said wrap yarn.

7. A pile fabric according to claim 6 wherein said binder strands comprise between about 5 to 8 percent by weight of the wrap yarn.

8. A pile fabric according to claim 2 wherein said fusible thermoplastic material forming said binder strand is a hot melt adhesive copolymer.

9. A pile fabric according to claim 8 wherein said hot melt adhesive copolymer comprises a copolyamide.

10. A pile fabric according to claim 8 wherein said hot melt adhesive copolymer comprises a copolyester.

11. A pile fabric according to claim 2 wherein the staple fibers of said body strand are selected from the group consisting of: polyamide, polyester, polypropylene and acrylic fibers.

12. A pile fabric according to claim 2 wherein said staple fiber body strands are about a 10's count.

13. A pile fabric comprising interengaging ground yarns and cut pile tufts formed from wrap yarns and extending from the ground yarns and forming the face of the fabric, each of said wrap yarns comprising a body strand of untwisted staple fibers and a binder strand helically wrapped around said body strand, said binder strand being formed of a heat shrinkable and fusible thermoplastic material having a predetermined relatively low melting point temperature and said ground yarns and said body strands being formed of fibers unaffected by such low melting point temperature so that the binder strand may readily be melted at temperatures which do not affect the integrity of the ground yarns and staple fibers, said binder strand having been heated to said predetermined melting point temperature so as to cause the binder strand to be retracted and repositioned inwardly away from the cut face of the pile fabric and to be melted and resolidified into randomly arranged discrete portions of binder strand material having no resemblance to a strand, and some of said discrete portions fusibly interconnecting some of said staple fibers of said body strand with one another and with said ground yarns.

14. A pile fabric comprising interengaging ground yarns and cut pile tufts formed of wrap yarns extending therefrom and forming the face of the fabric, each of said wrap yarns comprising a body strand of untwisted staple fibers and a binder strand helically wrapped around said body strand, and wherein said binder strand is formed of a crimped textured thermoplastic polymer having heat shrinkable and fusible properties and extensible and retractable properties and a relatively low melting point of less than about 300° F., and at which relatively low melting point temperature said staple fibers and ground yarns remain unaffected, and wherein said binder yarns are retractably positioned inwardly away from the face of the pile fabric so as to be hidden among the pile tufts and not to be visible.

15. A wrap yarn adapted to be used for forming various types of fabric including pile in a cut pile fabric and comprising a body strand formed of untwisted staple fibers and a binder strand helically wrapped around said body strand, and wherein said binder strand is formed of a fusible thermoplastic polymer having a relatively low melting point of less than about 300° F., and at which such relatively low melting point temperature the binder strand melts into randomly arranged discrete portions and fusibly connects portions of the staple fibers of said body strand when resolidified, and at which relatively low melting point temperature said staple fibers remain unaffected.

16. A wrap yarn according to claim 15 wherein said binder strand is a textured strand.

17. A wrap yarn according to claim 15 wherein said binder strand is a crimped textured strand and has extensible and retractable properties and is wrapped around said body strand in a tensioned condition so as to be axially extended and reduced in bulk compared to the condition the binder strand would assume when relaxed.

18. A wrap yarn according to claim 15 wherein said binder strand comprises a crimped textured multifilament yarn.

19. A wrap yarn according to claim 18 wherein said crimped textured multifilament binder strand is false twist crimped and textured.

20. A wrap yarn according to claim 15 wherein said binder strand is shrinkable when subjected to temperatures less than the melting point thereof.

21. A wrap yarn according to claim 15 wherein said fusible thermoplastic polymer forming said binder strand is a hot melt adhesive copolymer.

22. A wrap yarn according to claim 21 wherein said hot melt adhesive copolymer comprises a copolyamide.

23. A wrap yarn according to claim 21 wherein said hot melt adhesive copolymer comprises a copolyester.

24. A wrap yarn according to claim 15 wherein the staple fibers of said body strand are selected from the group consisting of: polyamide, polyester, polypropylene and acrylic fibers.

25. A wrap yarn according to claim 15 wherein said binder strand comprises between about 5 to 8 percent by weight of said wrap yarn.

26. A wrap yarn according to claim 15 wherein said binder strand has a size of approximately 40 denier and said staple fiber body strand is about a 10's count.

27. A wrap yarn adapted to be used for forming various types of fabric including pile in a cut pile fabric and comprising a body strand formed of untwisted staple fibers and a binder strand helically wrapped around said body strand, and wherein said binder strand is formed of a shrinkable, fusible thermoplastic polymer having a melting point of less than about 300° F., and wherein said binder strand shrinks and retracts when subjected to temperatures less than said melting point of said binder strand and melts into randomly arranged discrete portions and fusibly connects portions of the staple fibers of said body strand when subjected to such relatively low melting point temperature and resolidified, and at which relatively low melting point temperature said staple fibers remain unaffected.

28. A wrap yarn adapted to be used for forming various types of fabric including pile in a cut pile fabric and comprising a body strand formed of untwisted staple fibers and a binder strand helically wrapped around said body strand, and wherein said binder strand is formed of a fusible thermoplastic polymer having a predetermined relatively low melting point at which said binder strand melts into randomly arranged discrete portions and fusibly connects portions of the staple fibers of said body strand, and wherein said staple fibers of said body strand are formed of a different material which remains unaffected at said predetermined relatively low melting point.

29. A wrap yarn adapted to be used for forming various types of fabric including pile in a cut pile fabric and comprising a body strand formed of untwisted staple fibers and a crimped textured binder strand having extensible and retractable properties and formed of a fusible thermoplastic polymer having a relatively low melting point of less than about 300° F., said binder strand being helically wrapped around said body strand in a tensioned condition so as to be axially extended and reduced in bulk compared to the condition the binder strand would assume when relaxed.

30. A method of making a pile fabric comprising:

(a) forming a cut pile fabric having interengaging ground yarns and utilizing wrap yarns for the pile thereof, and wherein each of the wrap yarns comprises a body strand of untwisted staple fibers and a binder strand helically wrapped around said body strand, and wherein said binder strand is formed from a fusible thermoplastic polymer having a relatively low melting point of less than about 300° F., and at which relatively low melting point temperature said staple fibers and ground yarns remain unaffected;

(b) applying heat to the pile fabric so as to heat the fabric to said low melting point temperature and to melt the binder strand into randomly arranged discrete portions of binder strand material positioned inwardly away from the cut face of the pile fabric and having no resemblance to a strand; and (c) thereafter permitting the randomly arranged discrete portions of binder strand material to resolidify and fusibly interconnect staple fibers forming some of the lower portions of the body strands with one another and to permit some of said randomly arranged resolidified discrete portions to connect some of said staple fibers with the ground yarns.

31. A method according to claim 30 including backcoating the fabric, and then passing the backcoated fabric through a finishing operation wherein the finishing operation includes further applying heat to the fabric, brushing the pile of the heated fabric and shearing the brushed pile fabric.

32. A method of improving the hand, appearance and structural integrity of a cut pile fabric in which the pile tufts are formed of wrap yarns extending from interengaging ground yarns and wherein each wrap yarn comprises a body strand formed of untwisted staple fibers and a binder strand, with the binder strand being formed of a fusible thermoplastic polymer having a relatively low melting point of less than about 300° F., and at which relatively low melting point temperature the body strand and ground yarns remain unaffected so that the binder strand may readily be melted at temperatures which do not affect the integrity of the staple fibers or ground yarns; said method comprising:

(a) applying heat to the pile fabric so as to heat the fabric to said low melting point temperature and to melt the binder strands into randomly arranged discrete portions of binder strand material positioned inwardly away from the cut face of the pile fabric and having no resemblance to a strand; and (b) thereafter permitting the randomly arranged discrete portions of binder strand material to resolidify and fusibly interconnect staple fibers forming some of the lower portions of the body strand with one another, and to permit some of said randomly arranged resolidified discrete portions to connect some of said staple fibers with the ground yarns.

33. A method according to claim 32 including brushing the pile of the fabric following the step of applying heat thereto, and then shearing the brushed pile face of the fabric.

34. A method according to claim 32 including the further step of applying a backcoating to the pile fabric.

35. A method according to claim 32 including passing the fabric through a finishing operation which includes said step of applying heat to the pile fabric, and further includes brushing the pile of the heated fabric, and shearing the brushed pile fabric.

36. A method of making a pile fabric, comprising:

(a) forming an uncut pile fabric having interengaging ground yarns and utilizing wrap yarns for the pile thereof, and wherein each of the wrap yarns comprises a body strand of untwisted staple fibers and a crimped textured binder strand having extensible and retractable properties and formed of a fusible thermoplastic polymer having a relatively low melting point temperature of less than about 300° F. and at which relatively low melting point temperature the staple fibers of the body strand and the ground yarns remain unaffected, the binder strand being helically wrapped around the body strand in a tensioned condition so as to be axially extended and reduced in bulk compared to the condition the crimped textured binder strand would assume when relaxed; and (b) cutting the pile yarns so as to form pile tufts on the face of the fabric, said cutting of the pile yarns relaxing the tensioned condition of said crimped textured binder strands, thereby causing the binder strands to retract to a position inwardly from the cut face of the pile fabric.

37. A method of making a woven pile fabric comprising:

(a) forming upper and lower woven ground fabrics while utilizing pile wrap yarns extending between and interconnecting the upper and lower ground fabrics and wherein each of the wrap yarns comprises a body strand of untwisted staple fibers and a crimped textured binder strand having extensible and retractable properties and formed from a fusible thermoplastic polymer having a relatively low melting point of less than about 300° F., and at which relatively low melting point temperature the staple fibers of the body strand and the ground yarns remain unaffected, the binder strand being helically wrapped around the body strand in a tensioned condition so as to be axially extended and reduced in bulk compared to the condition the crimped textured binder strand would assume when relaxed; and (b) separating the upper and lower ground fabrics from one another by cutting the interconnecting pile yarns between the upper and lower ground fabrics so as to form pile tufts on the face of each of the separated pile fabrics, said cutting of the pile yarns relaxing the tensioned condition of the crimped textured binder strands, thereby causing the binder strands to retract to a position inwardly from the cut face of the pile fabric.

38. A method according to claim 37 including passing the cut pile fabric through a prefinishing operation, backcoating the prefinished fabric, and then passing the backcoated fabric through a finishing operation, and wherein the prefinishing and finishing operations each include applying heat to the fabric, brushing the pile of the heated fabric and shearing the brushed pile fabric.

39. A method of improving the hand and appearance of the face of a cut pile fabric having interengaging ground yarns and in which the pile tufts are formed of wrap yarns and wherein each wrap yarn comprises a body strand formed of untwisted staple fibers and a crimped textured binder strand helically wrapped around the body strand and having extensible and retractable properties and formed from a fusible thermoplastic polymer having a relatively and melting point temperature of less than about 300° F., at which relatively low melting point temperature the staple fibers and ground yarns remain unaffected, and wherein said binder strand shrinks and retracts when subjected to temperatures less than said melting point of the binder strand, said method comprising:

applying heat to the pile fabric so as to cause the binder strands of the pile tufts to retract inwardly in a direction away from the face of the pile fabric and to be hidden among the pile tufts and to also permit upper portions of the body strands to expand and enhance the uniformity of the face of the pile fabric.

* * * * *